US005975293A

United States Patent [19]

Fowler

[11] Patent Number: 5,975,293

[45] Date of Patent: Nov. 2, 1999

[54] SPORTS EQUIPMENT BAG

[75] Inventor: Jim C. Fowler, Florence, Ala.

[73] Assignee: Bat-A-Rack, Inc., Florence, Ala.

[21] Appl. No.: 09/120,475

[22] Filed: Jul. 23, 1998

[51] Int. Cl.[6] ..... B65D 35/00

[52] U.S. Cl. ..... 206/315.9; 206/315.1; 206/579

[58] Field of Search ..... 206/315.1, 315.6, 206/315.9, 579; 190/109, 102

[56] References Cited

U.S. PATENT DOCUMENTS

| | | |
|---|---|---|
| D. 370,560 | 6/1996 | Doerbaum . |
| 2,889,863 | 9/1959 | Arnold, Jr. . |
| 4,693,402 | 9/1987 | Comeau . |
| 4,793,532 | 12/1988 | Cash . |
| 4,890,731 | 1/1990 | Mroz . |
| 4,968,048 | 11/1990 | Lortie . |
| 5,224,602 | 7/1993 | Bettles et al. . |
| 5,273,298 | 12/1993 | Brown, Sr. . |
| 5,356,002 | 10/1994 | Brown . |
| 5,588,529 | 12/1996 | Speck . |

*Primary Examiner*—David T. Fidei
*Attorney, Agent, or Firm*—Waddey & Patterson, P.C.; John C. Garvin, Jr.

[57] ABSTRACT

A sports bag for housing and transporting the equipment of a baseball/softball team. The sports bag comprises a flexible container with side walls and a top cover, a plurality of inserts for housing bats, one or more inserts for housing balls, a plurality of compartments for storing gloves, helmets, catcher's equipment, scorebooks, and the like, a strap for carrying purposes, one or more openings for the easy dispensing of balls, and hooks for attaching the sports bag to a fence to allow the sports bag to serve as a bat rack.

16 Claims, 1 Drawing Sheet

SPORTS EQUIPMENT BAG

FIELD OF THE INVENTION

The present invention generally relates to baseball/softball equipment bags, and more particularly to a baseball/softball equipment bag that conveniently stores bats, gloves, balls, helmets, catcher's equipment, and the like, and which is adapted to hang from support, such as a fence, for conversion to a bat rack and ball dispenser.

BACKGROUND OF THE INVENTION

A baseball/softball team will generally carry to games substantial equipment such as bats, balls, gloves, helmets, catcher's equipment and the like. Numerous bats are required due to differing preferences of the players. Numerous balls are needed for warm-up purposes. Each player needs a glove or mitt to catch the balls. The catcher requires special equipment such as a mask, shin guards, chest protector and the like for safety purposes. The team also requires other items such as scorebooks, first aid items, etc. Typically, this equipment is loosely carried and stored in one or more duffle bags having a single compartment which allows the equipment to be commingled, become disorganized, and difficult to readily locate. During the game, the bats are allowed to lean against the fence, lay on the ground, or remain in the duffel bag(s). The bats and balls are often difficult to locate and sometimes misplaced in this way.

Numerous United States patents have been granted for carrying and storing baseball/softball equipment. The United States patents includes: Pat. No. Des. 370,560 to Doerbaum; Pat. No. 2,889,863 to Arnold, Jr.; Pat. No. 4,693,402 to Comeau; Pat. No. 4,793,532 to Cash; Pat. No. 4,890,731 to Mroz; Pat. No. 4,968,048 to Lortie; Pat. No. 5,224,602 to Bettles et al; Pat. No. 5,273,298 to Brown, Sr.; Pat. No. 5,356,002 to Brown; and Pat. No. 5,588,529 to Speck.

U.S. Pat. No. Des. 370,560 to Doerbaum discloses an ornamental design for a baseball equipment bag having several compartments. U.S. Pat. No. 2,889,863 to Arnold, Jr. discloses an elongated flexible canvas sheet having a plurality of pockets for holding baseball bats in neatly arranged positions and which facilitates the carrying of the bats. U.S. Pat. No. 4,693,402 to Comeau discloses a backpack for carrying sports equipment such as baseball bats, balls and gloves for a single player. U.S. Pat. No. 4,793,532 to Cash discloses a carrier for baseball bats and balls and which has hooks for attaching the carrier to a fence. U.S. Pat. No. 4,890,731 to Mroz discloses a personal sports carrier for baseball/softball bats and baseballs/softballs. U.S. Pat. No. 4,968,048 to Lortie discloses a cart for carrying baseball bats and which incorporates a cylinder which defines a space for holding other sports equipment such as gloves, baseballs, helmets and the like. U.S. Pat. No. 5,224,602 to Bettles et al. discloses a rigid case for carrying baseball bats and balls and which also serves as a bat rack and ball dispenser when opened at the playing field. U.S. Pat. No. 5,273,298 to Brown, Sr. discloses a compartmentalized cart for baseball/softball equipment for its easy transport and use. U.S. Pat. No. 5,356,002 to Brown discloses a personal baseball/softball utility bag having separate accessible compartments for storing a glove, clipboard, bats, and baseball shoes and which enables the player to prevent debris from his baseball shoes contacting the rest of the equipment stored in the bag. U.S. Pat. No. 5,588,529 to Speck discloses a baseball/softball equipment bag having an elongated bag portion for housing bats, interior shelves for storing items such as gloves, balls, caps and playing shoes, and an adjustable strap for carrying the bag.

While the prior art patents disclose some of the features of the present invention, none of them incorporate all of the features of the sports bag of the present invention which allows a baseball/softball team to house its equipment in an orderly fashion and carry it to games. The sports bag of the present invention is particularly useful for teams of young players who play in Little Leagues or the like.

SUMMARY OF THE INVENTION

In accordance with the present invention, there is provided an equipment bag adapted for storing and carrying most of the equipment of a baseball or softball team. The equipment bag includes a flexible body, a top cover, a plurality of inserts for housing bats, one or more inserts for housing balls, a plurality of compartments for storing gloves, helmets, catcher's equipment, scorebooks, and the like. The equipment bag further includes an adjustable strap for its easy transportation, one or more hooks for attaching the bags to a fence normally adjacent the dugout of the team which allows the bag to be used as a bat rack, and means adjacent the bottom of the bag to permit the easy dispensing of the balls. The bats are positioned within the bag such that they are separated in an orderly fashion which protects the bats and permits their easy removal from the bag. The balls are positioned and stacked within the body in an orderly fashion to protect the balls and permits their easy removal from the body through one or more openings adjacent the bottom of the bag. The plurality of compartments are positioned within the body such that other equipment such as helmets, catcher's equipment, gloves, scorebooks, and the like are separated in an orderly fashion which protects the equipment and permits the easy finding and removal of same.

Accordingly, it is an object of the present invention to provide an equipment bag for a baseball/softball team for housing and storing the equipment in an orderly fashion and which protects the equipment.

It is another object of the present invention to provide an equipment bag for a baseball/softball team for housing and storing the equipment in an orderly fashion for easy and ready transportation of the equipment.

It is a further object of the present invention to provide an equipment bag for a baseball/softball team for housing and storing the equipment in an orderly fashion and permits the easy removal of the equipment from the bag.

It is still a further object of the present invention to provide an equipment bag for a baseball/softball team for housing and storing the equipment in orderly and protected fashions and allows the equipment bag to be used as a bat rack during games and practice.

These objects as well as other objects of the present invention will become more readily apparent after reading the following description in conjunction with the accompanying drawings.

DESCRIPTION OF THE PREFERRED EMBODIMENT OF THE INVENTION

Figure 1:
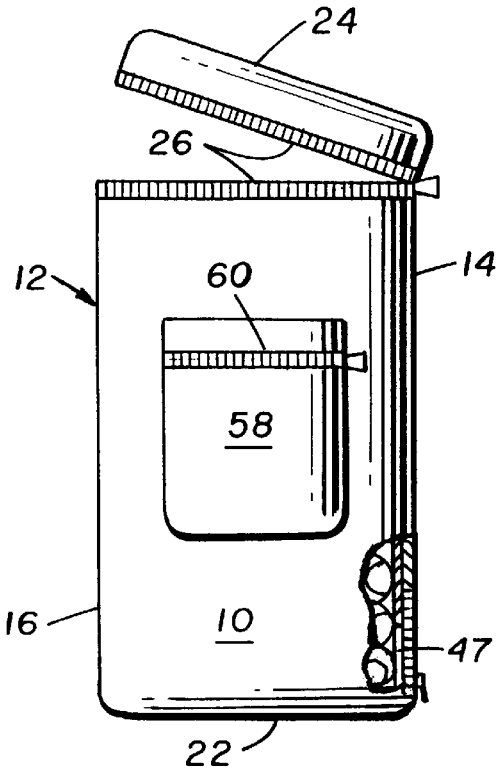
FIG. 1 is a front elevational view of the baseball/softball equipment bag of the present invention with its top cover in a partially opened position.

With reference to the drawings, reference numeral 10 generally designates the baseball/softball equipment bag of the present invention. Bag 10 comprises a body 11 including a sidewall 12 having an upper end 14 and a lower end 16. Body 11 further includes an interior surface 18, an exterior surface 20, and a closed bottom 22. A top cover 24 (FIGS. 1 and 2) is secured to upper end 14 of sidewall 12 by a zipper 26. An elongated adjustable strap 28 (FIG. 2) having an upper end 30 and a lower end 32 which are secured to the exterior surface 20 of sidewall 12 of body 11 by any suitable means such as stitching 29, and having first and second buckles 34 and 35 for adjusting the strap 28. A pair of hooks 36 (FIG. 2) is secured to the exterior surface 20 of sidewall 12 by any suitable means such as stitching 37. The strap 28 is for use by a person to carry bag 10 either over his shoulder or by his side. The hooks 36 (FIG. 2) are for attaching bag 10 to a fence (not shown) normally found near the dugout of ball fields.

Figure 3:
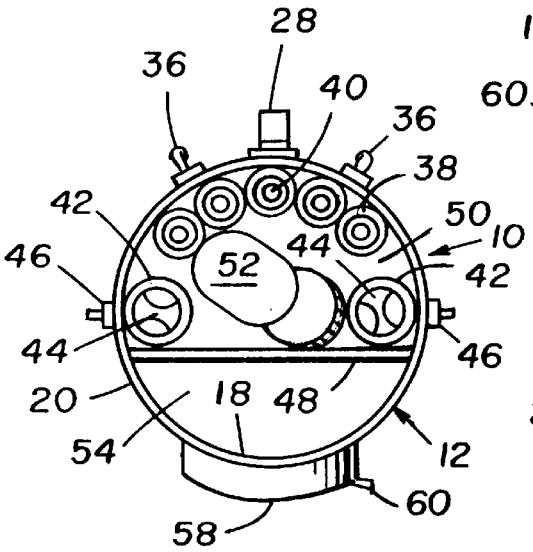
FIG. 3 is a top view of the baseball/softball equipment bag of the present invention, with its top cover removed to show the interior of the equipment bag and some of its contents.
Figure 4:
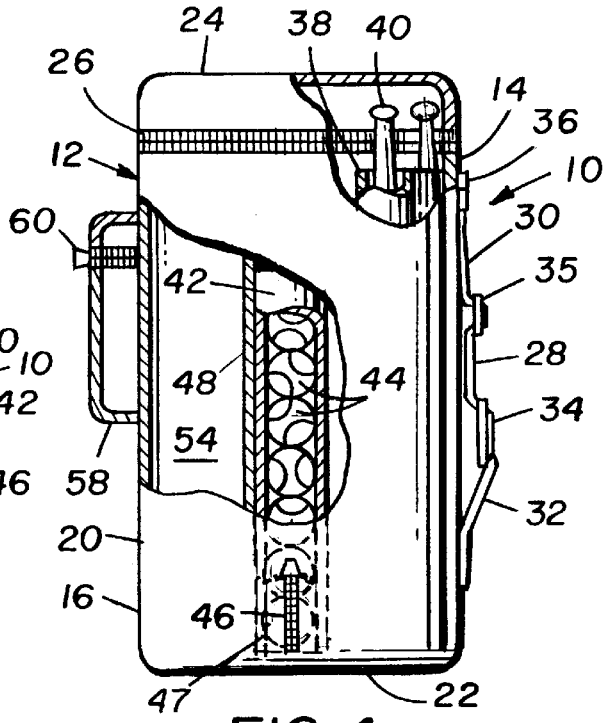
FIG. 4 is a side, partially broken away and in section, view of the baseball/softball equipment bag of the present invention showing a ball insert, a plurality of balls, a bat insert, two bats, and a zipper for one of the openings for dispensing the baseballs/softballs.

As best shown in FIGS. 3 and 4, a plurality of spaced inserts 38 for holding individual bats 40 are secured by any suitable means such as stitching or adhesives to the interior surface 18 of bag 10. Also, as best shown in FIG. 3, a pair of spaced inserts 42 for holding individual baseballs/ softballs 44 are secured by any suitable means such as stitching or adhesive to the interior surface 18 of bag 10. Each of the inserts 38 is closed along its side and bottom and opened at its top. Each of the inserts 42 is closed along its side and opened at its top and bottom. As best shown in FIGS. 3 and 4, a zipper 46 is provided in sidewall 12 of bag 10 near the bottom of each ball insert 42 in alignment with its opened bottom 47 for dispensing the balls 44 as required.

Figure 2:
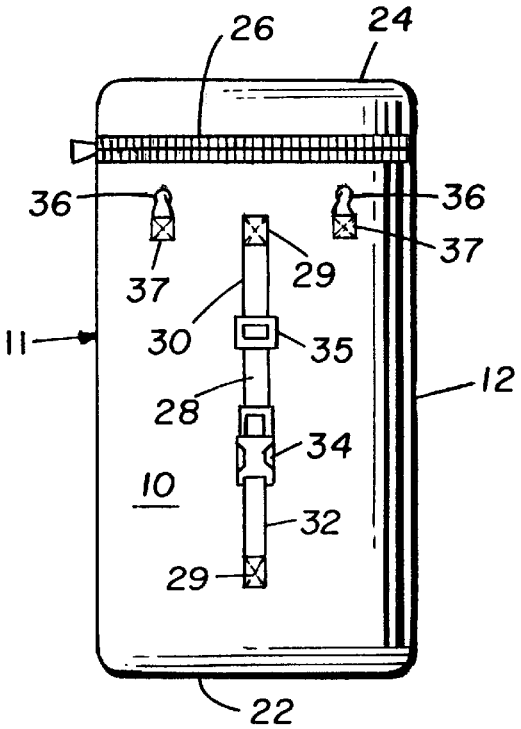
FIG. 2 is a rear elevational view of the baseball/softball equipment bag of the present invention with its top cover in a closed position.

As best seen in FIG. 3, a divider 48 is secured by any suitable means such as stitching or adhesive to the interior surface 18 of body 11 along its full length below the top cover 24 to form a first compartment 50 (FIG. 3) and a second compartment 54. As best seen in FIG. 3, batting helmets 52 may be stored in first compartment 50, and catcher's equipment (not shown) such as face masks, shin guards and chest protectors and other equipment such as gloves (not shown) may be stored in second compartment 54. As best seen in FIGS. 1, 3 and 4, a pocket 58 is secured to the lower end 16 of sidewall 12 for holding and storing one or more scorebooks (not shown). A zipper 60 is provided for opening and closing pocket 58.

As is apparent, bag 10 and its components can be made of any suitable material. The body 11, top cover 24, inserts 38 and 42, and divider 48 are preferably made from flexible, water repellent, nylon, polyester, canvas or any other suitable material. However, these components could be made from a suitable rigid material such as plastic or wood. Strap 28 is preferably made of a flexible nylon, polyester or canvas, web material, but it could be made from any other suitable material.

While the above description constitutes a preferred embodiment of the present invention, it will be appreciated that the invention is susceptible to modification, variation and change without departing from the proper scope and fair meaning of the accompanying claims.

I claim:

1. A sports bag for holding and storing sports equipment including bats, balls, batting helmets, catcher's equipment and scorebooks, said bag comprising:

a flexible, elongated, body having an open upper end, a closed lower end, an interior surface, an exterior surface and having a length;

means for accessing said body;

a plurality of inserts secured to said interior surface of said body for holding and housing the bats;

at least one insert secured to said interior surface of said body and running the full length thereof for holding and housing the balls;

at least one divider secured to said interior surface for dividing said interior into a plurality of compartments, at least one of said compartments being disposed for holding and housing the batting helmets; and a pocket secured to said exterior surface of said body for holding and housing the score books.

2. The sports bag of claim 1 wherein said means for accessing said body includes a top cover and means for securing said top cover to said upper end of said sidewall.

3. The sports bag of claim 2 wherein said means for securing said top cover to said upper end of said sidewall includes a zipper.

4. The sports bag of claim 3 wherein at least one of said compartments is disposed for holding and housing the catcher's equipment.

5. The sports bag of claim 4 wherein at least one of said compartments is disposed for holding and housing the batting helmets.

6. The sports bag of claim 5 wherein said body further comprises at least one hook secured to said upper end of said sidewall for vertically hanging said body from a support.

7. The sports bag of claim 6 wherein said body further comprises means in association with said at least one insert and said lower end of said body for dispensing the balls from said at least one insert.

8. A sports bag for holding and storing sports equipment including bats, balls, batting helmets, gloves, catcher's equipment, and scorebooks, said bag comprises:

a flexible, elongated, tubular body having an upper end, a lower end, an interior surface, and an exterior surface;

a top cover and means for securing said top cover to said upper end of said tubular body;

a plurality of upstanding inserts secured to said interior surface of said bag for holding and housing the bats;

a plurality of upstanding inserts secured to said interior surface of said body and running substantially the full length thereof for holding and housing the balls;

at least one divider secured to said interior surface for dividing said interior into a plurality of compartments, at least one of said compartments being disposed for holding and housing the batting helmets; and a pocket secured to said exterior surface of said body for holding and housing the scorebooks.

9. The sports bag of claim 8 wherein said means for securing said top cover to said upper end of said sidewall includes a zipper.

10. The sports bag of claim 9 wherein at least one of said compartments is disposed for holding and housing the catcher's equipment.

11. The sports bag of claim 10 wherein said body further comprises means in association with said plurality of inserts for holding and housing the balls and said lower end of said bag for dispensing the balls from said inserts.

12. The sports bag of claim 10 wherein said body further comprises means in association with said plurality of inserts for holding and housing the balls and said lower end of said body for dispensing the balls from said inserts.

13. The sports bag of claim 12 wherein said bag comprises a plurality of hooks secured to said upper end of said sidewall for vertically hanging the bag on a support.

14. The sports bag of claim 8 wherein said body is provided with a closure means adjacent said lower end; and, said plurality of upstanding inserts for holding and housing said balls includes an open lower end for dispensing said balls through said closure means.

15. A compartmentalized sports bag for storing various pieces of sports equipment comprising a body having an upper end, a lower end, a length, and first and second compartments separated by a common wall extending substantially the length of the body and being secured inside said body; said first compartment being subdivided into a plurality of elongated pockets for receiving and storing selected pieces of said sports equipment; at least one of said elongated pockets being provided with a lower end having an opening therein and being disposed for receiving a plurality of sport balls therein in stacked relation; said lower end of said body including means for providing access to the lowermost of said stacked sport balls for the removal of the sport balls from said at least one elongated pocket and for closing said opening in said lower end of said at least one pocket.

16. The sports equipment bag of claim 15 wherein at least one of said plurality of elongated pockets is disposed for receiving and storing a ball bat.

* * * * *